United States Patent [19]

Bondon

[11] Patent Number: 4,458,251

[45] Date of Patent: Jul. 3, 1984

[54] CONCAVE REFLECTOR FOR RADIO ANTENNA USE

[75] Inventor: David L. Bondon, Colts Neck, N.J.

[73] Assignee: Prodelin, Inc., Highstown, N.J.

[21] Appl. No.: 265,214

[22] Filed: May 19, 1981

[51] Int. Cl.[3] ..... H01Q 15/16

[52] U.S. Cl. ..... 343/914; 343/916

[58] Field of Search ..... 343/912, 915, 916, 840, 343/914

[56] References Cited

U.S. PATENT DOCUMENTS

| | | | |
|---|---|---|---|
| 3,029,433 | 4/1962 | Sokol | 343/912 |
| 3,108,279 | 10/1963 | Eisentraut | 343/914 |
| 3,234,550 | 2/1966 | Thomas | 343/912 |
| 3,249,947 | 5/1966 | Williams | 343/912 |
| 3,427,625 | 2/1969 | Kazimi | 343/914 |
| 3,543,278 | 11/1970 | Payne | 343/915 |
| 4,355,317 | 10/1982 | Muzio | 343/912 |

FOREIGN PATENT DOCUMENTS

| | | | |
|---|---|---|---|
| 55-117303 | 9/1980 | Japan | 343/915 |

*Primary Examiner*—Eli Lieberman

*Attorney, Agent, or Firm*—Wolf, Greenfield & Sacks

[57] ABSTRACT

A parabolic reflector for microwave antennae which can be assembled from a plurality, for example eight, identical and interchangeable rigid fiberglass panels is shown. The panels have rigidizing ribs formed on their rear surfaces, integrally with each panel and made of the same material, to assure thermal stability and mechanical rigidity. A mounting ring is produced by some of these ribs while others located on the radial margins of the panels incorporate self-indexing devices for automatically lining up the front surfaces of the panels flush with each other, when the reflector is assembled from the rear surface.

13 Claims, 8 Drawing Figures

CONCAVE REFLECTOR FOR RADIO ANTENNA USE

INTRODUCTION

This invention relates in general to highly directive radio antennae which employ concave reflectors, typically those having parabolic surfaces, and useful in terrestrial microwave communications, as well as for gathering signal energy from a far distant source, such as a satellite. More particularly, the invention relates to a concave reflector for such radio antennae which is made of substantially identical segments that can be assembled along radial boundary lines to form a complete reflector, each of said segments being independently formed in a fixed substantially rigid configuration of moldable material.

Objects of the invention include portability, ease of assembly to form a rigid, accurately focused reflector of light weight both as assembled and in its individual parts, and thermal and mechanical stability of both the parts and the assembled reflector. The parts or segments of the reflector are identical in structure, interchangeable and incorporate self-indexing flanges along their radial boundaries which require no guide pins and can be assembled into a reflector having one continuous reflector surface. Preferred materials are a molded fiberglass which is thermally and mechanically stable, and, capable of surviving harsh weather, rough handling and high winds as experienced in harsh environments, and can shed ice easily in most locations. The segments are each of such size and weight as to be hand-portable. A typical reflector is made of a plurality of interchangeable segments, for example, a 10-foot reflector may be made of eight segments each weighing less than fifteen pounds, the entire reflector when assembled weighing only about one hundred and forty pounds. The shipping weight of the components of such a 10-foot antenna is approximately one hundred and sixty pounds, and the shipping volume of the unassembled components is approximately sixty cubic feet. The result is an antenna reflector of extremely light weight which can be shipped at low cost, can be handled easily and can be assembled accurately from the rear with only simple tools. No specially trained crews, unusual or uncommon tools, heavy trucks or cranes are necessary. Well-known molding or casting fixtures are useful to make the individual components. By incorporating rigidizing ribs, connecting flanges, indexing tabs, a mounting ring and a reflecting surface in one integral molding or casting of each segment, the invention greatly reduces the number of parts needed to assemble a complete concave reflector.

PRIOR ART

It has long been a goal of antenna designers to provide multi-petal or multi-segment reflector dishes for directional antennae which can be taken down for transportation and assembled on a use site. The following patents will serve to illustrate the state of the art as known to the applicant at the present time:

| PATENT NO. | DATE OF ISSUE | INVENTOR |
|---|---|---|
| 2,181,181 | 11/28/39 | Gerhard |
| 2,471,828 | 5/31/49 | Mautner |
| 2,572,430 | 10/23/51 | Balton |
| 2,997,712 | 8/22/61 | Kennedy |

-continued

| PATENT NO. | DATE OF ISSUE | INVENTOR |
|---|---|---|
| 3,234,550 | 2/8/66 | Thomas |
| 3,235,872 | 2/15/66 | Scheips |
| 3,438,045 | 4/8/69 | Braccini |
| 3,543,278 | 11/24/70 | Payne |
| 3,832,717 | 8/27/74 | Taggart, Jr. |
| 3,855,598 | 12/17/74 | Keller |
| 3,964,071 | 6/15/76 | Townes, Jr. |
| 3,969,731 | 6/13/76 | Jenkins |
| 3,971,023 | 7/20/76 | Taggart |
| 2,842,767 | 7/8/58 | Darrouzet |

In the foregoing collection, the patents of Gerhard, Mautner, Kennedy, Taggart and Taggart, Jr., Thomas, Scheips and Payne all deal with antennae which can be assembled from segments, or petals. Of these, only Gerhard, Mautner and Kennedy are concerned with antennae which can be assembled and disassembled more than once. The remaining patentees describe antennae which, once assembled, are apparently not intended to be disassembled and transported to another location. The patents of Balton and Braccini have adjustable reflectors, in Balton's case including extendable or foldable sections, which are permanently attached to a smaller antenna for extending the area of the reflector in use. These are not reflectors which can be assembled on the site, and disassembled for transportation to another location if desired. The patents of Keller, Townes, Jr., Jenkins and Darrouzet all deal with reflector materials; while such materials are obviously useful in antenna reflectors of the present invention, they are not the subject of the invention and therefore these patents are not pertinent to the invention.

The Gerhard patent represents a class of concave reflectors featuring an inner core section and add-on outer sections which can be attached in a removeable manner to the inner core section, to provide a concave antenna reflector assemblable from segments. The segments shown by Gerhard are divided along both radial and circumferential lines. Mautner's patent shows a basically similar structure, in which the central section has a spiral outer periphery and the outer segments are of decreasing size so that they can be nested one inside the other for shipment (FIG. 7). Kennedy's patent also features an inner core section and a plurality of outer "tip" sections which can be taken down and nested for shipment. In all three of these patents the antenna is made of metallic components with structural truss sections to provide stiffness, and a face mesh or screen to provide the reflector surface.

GENERAL NATURE OF THE INVENTION

The present invention provides a concave reflector for radio antenna use, which reflector is made of a plurality of substantially identical segments which can be assembled along radial boundary lines to form a complete reflector, each segment being independently formed in a fixed, substantially rigid configuration of moldable material, having a front portion providing a segment of the reflector surface and a rear portion containing integrally-formed rigidizing ribs of the same material so as to assure thermal stability by which the antenna can be completely assembled from the back. These ribs include at least a first marginal rib along the first radial margin and a second marginal rib along the second radial margin of each segment, the first rib of one segment being fastened to the second rib of the next-adjoining segment in the assembly of a complete reflector. The first and second marginal ribs include integrally-formed indexing means for so mating each pair of adjoining first and second ribs during assembly of the complete reflector that the segments of reflector surface form a substantially continuous reflector in which the edges of adjoining segments are substantially flush with each other. In this manner an entire concave reflector can be assembled from the rear and automatically a uniform reflecting surface will be provided. Intermediate ribs are interlocked with each other and with the marginal ribs through circumferential ribs. In a preferred embodiment of the invention the indexing means on the marginal ribs comprise a first set of tabs on the rear edge of each first rib which overlie and touch the rear edge of the second rib to which it is fastened, and a second set of tabs on the rear edge of the second rib which overlie and touch the rear edge of said first rib, the tabs of the first set being alternated with the tabs of the second set in a radial direction where the two adjoining ribs are fastened together. Desirably, the reflecting surface is treated so as to scatter incident solar energy.

A known form of parabolic antenna uses a separate, usually metallic, mounting ring for mounting the reflector to a support, which mounting ring has a radius about one half, more or less, of the radius of the aperture of the reflector. In a preferred embodiment of the present invention the rear portion of each segment contains also an integrally-molded sector of a mounting ring structure extending between the first and second marginal ribs and fixed on a circular locus the radius of which is the same as or less than the radius of the optical aperture of the reflector, and including means to attach the reflector to a support. A preferred attaching means is a rigid connecting member fastened from an end of one sector to the adjoining end of the next adjacent sector, there being at least as many of these connecting members as there are pairs of adjoining ends of the sectors of the mounting ring structure, so as to form a substantially rigid mounting ring at the rear of the reflector which is an integral part of the reflector; and at least some of the rigid connecting members are used to attach the reflector to a support. As is specifically illustrated in a preferred embodiment, the mounting ring structure is a pair of substantially parallel circularly oriented ribs, and the rigid connecting members are each fastened between the ribs at adjoining ends of the sectors of the mounting ring structure. The mounting ring is made of the same material as the reflector, thereby enhancing its thermal stability. Some of the ribs which form stiffening members thus also are used for the dual purpose of providing an interface between the reflector and a mounting structure.

Advantageously, the concave reflector segments of the invention can be compression molded, injection molded, or otherwise formed, depending primarily on the economic conditions which are encountered. Preferably, the segments of the reflector are molded of a dielectric material, such as fiberglass. In such case, an electrically reflective material, such as a wire mesh, located on the front surface or within the mass of the dielectric material close to the front surface of the finished segment, is incorporated during the forming process.

DETAILED DESCRIPTION OF THE DRAWINGS

Figure 1:
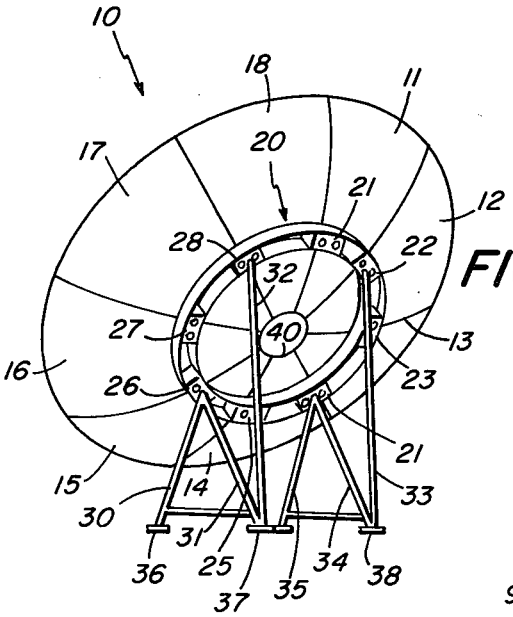
FIG. 1 illustrates an assembled reflector with integral mounting ring.

In FIG. 1 a concave reflector is assembled from eight segments or panels 11, 12, 13, 14, 15, 16, 17 and 18 respectively. The reflector incorporates a mounting ring 20 which is made up of an equal number of sectors each permanently and integrally-formed on the accompanying segment or panel. The mounting ring sectors are connected together by rigid joining members 21–28 inclusive. The mounting ring is fastened to stanchions 30, 31, 32, 33, 34 and 35 which in turn support the antenna on pads 36, 37 and 38 shown in FIG. 1. A central bore is left in the reflector and fitted with a rib 40 for passage of and the indexed support of a microwave antenna feed (not shown).

Figure 3:
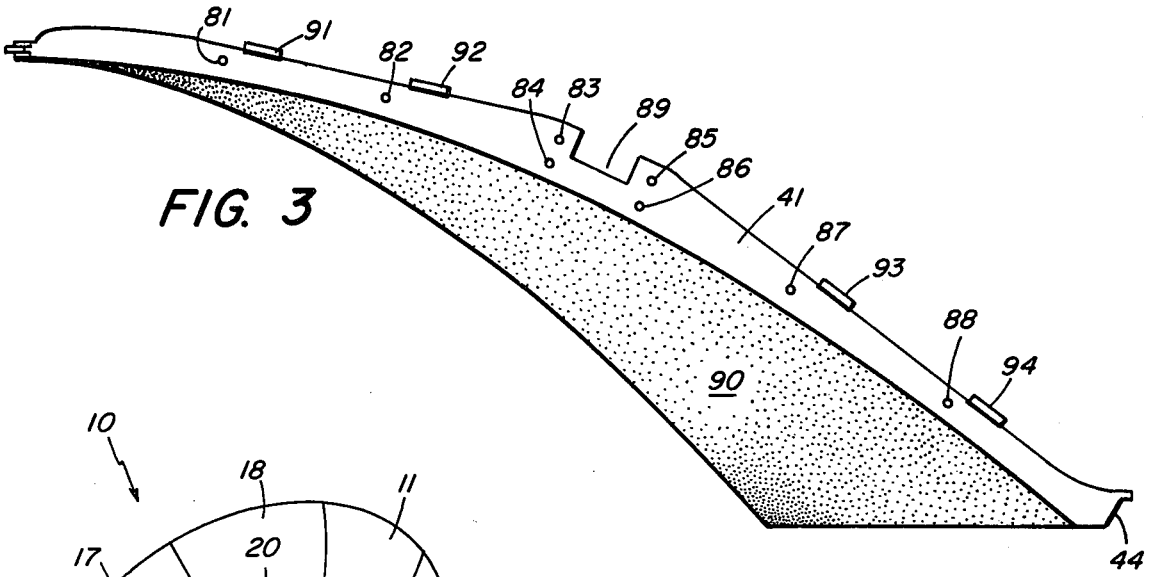
FIG. 3 is an edge-view on line 3—3 of FIG. 2.
Figure 2:
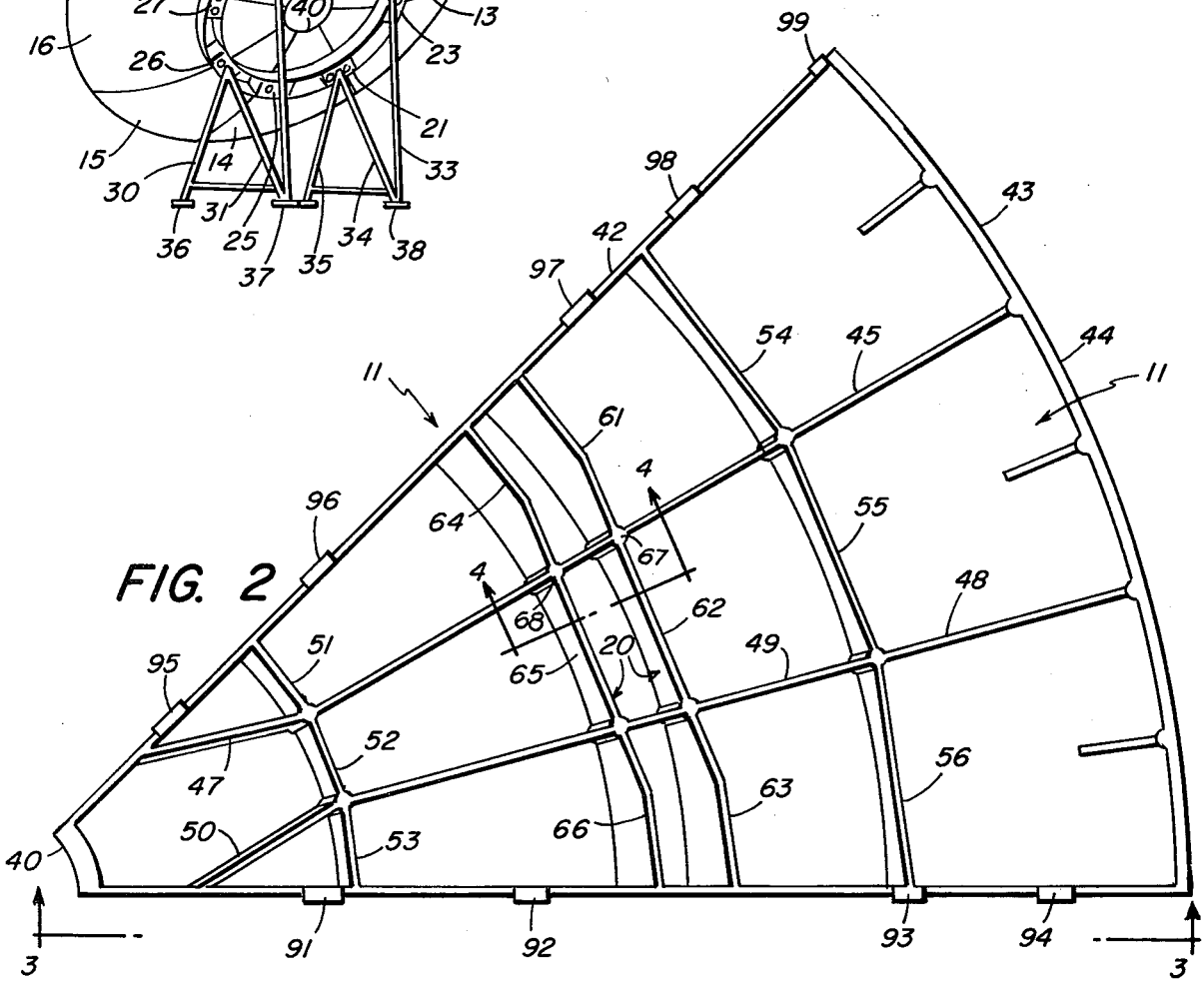
FIG. 2 is a rear view of a segment of the reflector.
Figure 6:
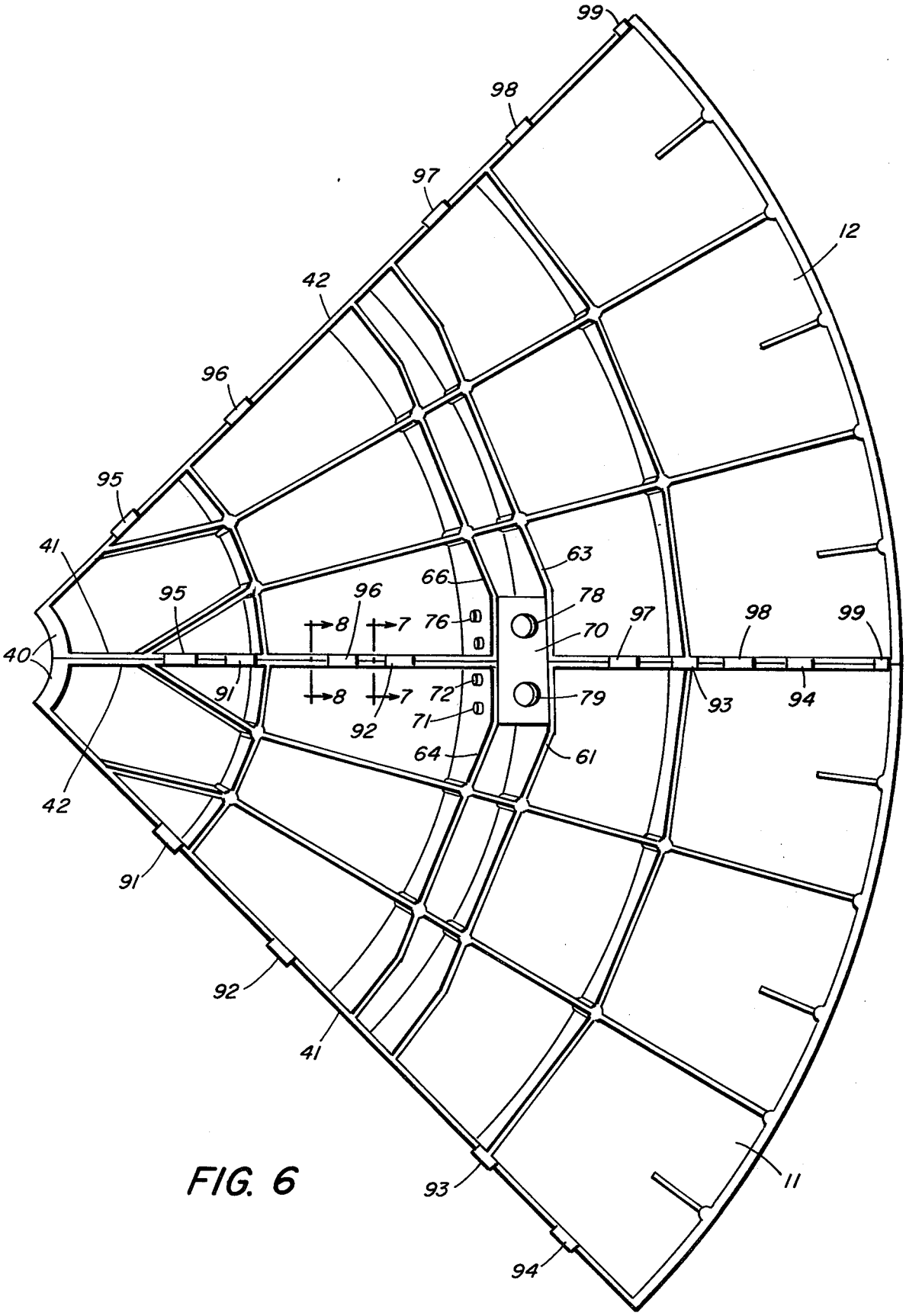
FIG. 6 shows two segments joined together.

FIG. 2 illustrates one of the reflector segments 11. Since all of the segments are identical, the illustration of this segment serves to illustrate all of the segments. FIG. 2 shows the structure of the rear or back surface of a segment, which incorporates marginal integral ribs 41, 42 for joining one segment to another and additional ribs 45–56, inclusive, for providing rigidity to each segment. Thus FIG. 2 incorporates a first radially extending marginal rib 41 along one edge of the segment and a second radially extending marginal rib 42 along the opposite edge of the segment. When the segments of the reflector are joined together, as is illustrated in FIG. 6, a first marginal rib of one segment mates with the second marginal rib of the next adjoining segment. FIG. 3 shows a side view of the first marginal rib, 41.

The radially extending marginal ribs 41 and 42 begin at the central aperture rib 40 and extend to the outer periphery 43 of each segment, the outer periphery being arcuate in form. An arc-shaped rib 44 is provided at the outer periphery of each segment, to provide stiffness to the assembled antenna at its periphery. Intermediate stiffening ribs 45, 46, 47 and 48, 49, 50 run respectively from the peripherial rib 44 toward the central bore rib 40. The inner-most segments 47 and 50 of these intermediate ribs diverge to join the marginal ribs 42 and 41, respectively. These intermediate radially oriented stiffening ribs are interconnected with a set of circumferentially-oriented stiffening ribs on various radii. A first circumferentially-oriented rib 51, 52, 53 runs between the marginal ribs 41, 42, in sections which intersect the intermediate ribs 46, 47 and 49, 50; and and a second circumferentially-oriented rib on a larger radius is composed of setions 54, 55, and 56, running between the marginal ribs 41, 42 in sections which intersect the intermediate ribs 45, 46 and 48, 49, respectively. A sector of the integral mounting ring structure 20 is made up of two parallel ribs 61, 62, 63 and 64, 65, 66, respectively, located between the first and second circumferentially-oriented ribs.

Figure 4:
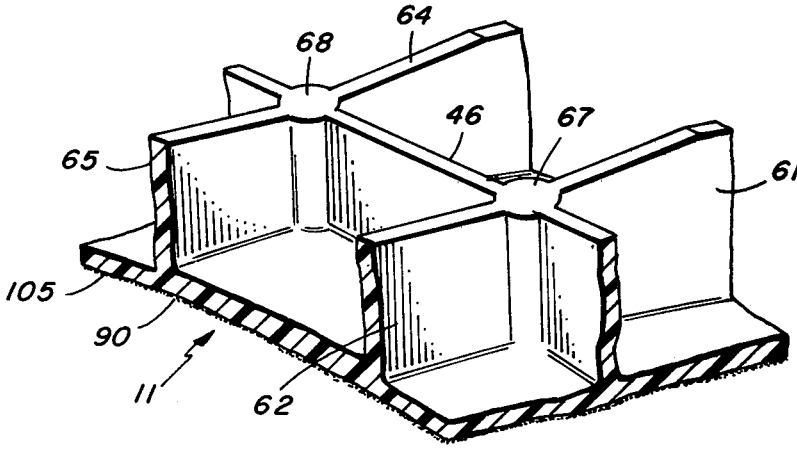
FIG. 4 is a partial section, enlarged, on line 4—4 of FIG. 2.

FIG. 4, which is an enlarged partial view of the portion of FIG. 2 in which rib sections 61 and 62 and rib sections 64 and 65 of the mounting ring join the intermediate stiffening radial rib 46, shows how the junctions where the ribs cross are formed. In each instance a joining boss or thickened portion 67, 68 respectively is provided, for strength. This structural feature is used throughout the rib structure on the rear surface of each segment, as is shown in FIGS. 2 and 6. These joining bosses are shaped like relatively thick posts with flat tops, against which ejection pins in the mold forming the segment push to eject the finished segment from the mold. These posts are located at the junction of ribs where pushing can be done with least risk of damage to the finished product. They therefore serve the dual purpose of distributing forces and providing strength both during ejection from the mold, and during operational use. The height of each rib of the mounting ring sector is increased as the rib approaches the marginal rib 41 or 42, as is illustrated at 61 and 64 in FIG. 4, for the purpose of providing increased structural strength for the rigid joining element 70 which is shown enlarged in FIG. 5, which connects together the mounting ring sectors of two adjacent segments 11 and 12, for example, of the reflector 10.

Figure 5:
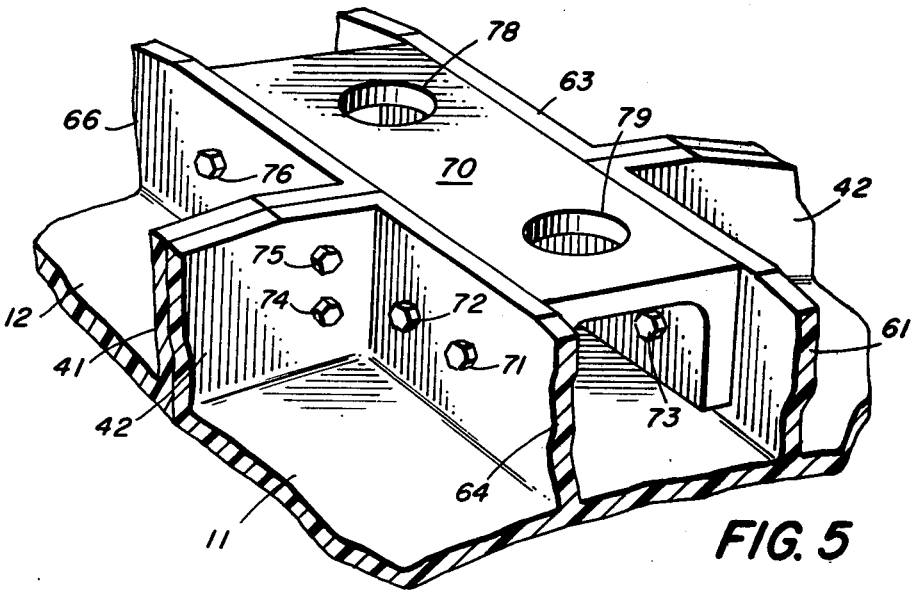
FIG. 5 illustrates a rigid connecting member connecting together two sectors of the integral mounting ring.

Referrring to FIGS. 5 and 6, two segments 11 and 12 of the reflector are shown joined together at their marginal ribs 42 and 41 respectively. The rib sections 61 and 64 of the mounting ring sector of the first segment 11 confront at their ends the rib sections 63 and 66, respectively, of the mounting ring sector of the second segment 12. A channel-shaped rigid connecting member 70 is fastened as by bolts 71–76, inclusive, between the confronting ends 61, 64, and 63, 66 of the mounting ring rib sections. Conveniently, the connecting member 70 may be made of a metal, such as aluminum without adversely affecting the thermal stability of the asembled reflector. It has two holes 78 and 79 in its bight part which can be used for attaching the connecting member to stanchions 31–35, inclusive, shown in FIG. 1. The particular mode of attachment is not a part of this invention and is therefore not illustrated. The connecting member 70 which is illustrated in FIG. 5 is representative of the connecting members 21–28, inclusive, shown in FIG. 1. Not all of the connecting members are required for attaching the mounting ring 20 to the stanchions 30–35, inclusive. Connecting member 70 can be made to overlie the ribs of the mounting rib as well as to fit between them, and additonal connecting members can be added between the marginal ribs 41, 42.

When the segments of the reflector 10 are joined together one after another, the marginal ribs 41, 42 of successive segments meet each other as is shown in FIGS. 5 and 6. Referring to FIG. 3, which shows the side face of one marginal rib 41, each of these ribs is provided with holes 81–88 inclusive, by which one marginal rib 41 may be bolted to an adjoining marginal rib 42. FIG. 5 shows two bolts 74 and 75 used for this purpose in holes such as the holes 83 and 84 of rib 41. A rectangular notch 89 in the marginal rib 41 is provided between sectors 63, 66 to accommodate the connecting member 70 shown in FIG. 5. As will be appreciated, the depth of the channnel 70 of which the connecting member 70 is made does not have to be the same as the depth of the notch 89.

Figure 7:
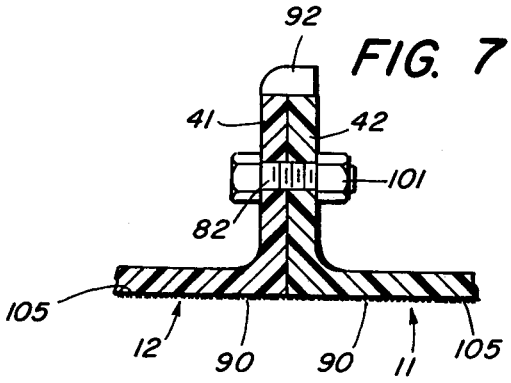
FIG. 7 is a partial sectional view showing an index tab, taken on line 7—7 in FIG. 2 and in FIG. 6.
Figure 8:
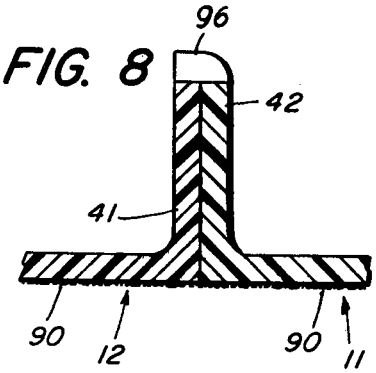
FIG. 8 is a partial sectional view showing an opposing index tab, taken on line 8—8 in FIG. 6.

The reflector 10 does not depend upon registration of holes 81–88 inclusive in the first marginal rib 41 of one segment with corresponding holes (not shown) in the second marginal rib 42 of an adjoining segment, for providing a flush meeting of their reflector surfaces 90. Each first marginal rib 41 is provided with tabs 91, 92, 93, and 94 on its outer edge which bend away from the first rib toward the second marginal rib 42 of the adjoining segment. Similarly, each second marginal rib 42 is provided with tabs 95–99, inclusive, on its outer edge which bend away from the rib toward the first marginal rib 41 of the adjoining segment. FIG. 7 which is taken on line 7—7 of FIGS. 2 and 6, illustrates how one of the tabs 92 on a first marginal rib 41 will overlie the upper margin of the adjoining marginal rib 42 of an adjoining segment when two segments 11 and 18 are joined together. Section line 7—7 is taken through hole 82 of a first marginal rib 41, and shows in longitudinal section a bolt 101 which joins two marginal ribs 41 and 42. The tab 92 extending from the top edge of the first rib 41 overlies the top edge of adjoining second rib 42. Tab 92 is an indexing tab which, if maintained in contact with the top edge of the adjoining second rib 42, will assure that the front surfaces 90 of the two segments 11 and 12 of the reflector meet flush with each other; that is, the respective front surfaces of 90 of each segment 11 and 12 will join or meet flush one to another at the corner edges of the meeting faces of the first and second marginal ribs 41 and 42. This result is assured by the tabs 95–98 which are integrally formed on the adjoining marginal rib 42 of the next adjoining segment, as is shown for segment 11 in FIG. 8.

As will be seen in FIGS. 2 and 6, the second marginal rib 42 of each segment, here segment 11, has tabs 95-99 oriented toward the first marginal rib 41 of an adjoining reflector segment 12. The tabs on the second marginal rib 42 of each segment are located, radially, at different distances from the central bore rib 40 than the tabs 91 to 94 on the first marginal rib 41. The second-rib tabs will alternate in a radial direction with the first-rib tabs in inter-digital relationship when the segments are joined together as is shown in FIG. 6. Thus in FIG. 8 which shows for example a tab 96 on the second marginal rib 42 of panel 11, the tab overlies the upper edge of the first marginal rib 41 of panel 12 a radial distance different from that of the tab 92 which is shown in FIG. 7. With this arrangement the tabs must force registration of the two marginal ribs 41, 42 independent of the size of the bolt holes and the bolts connecting them together which can then be left somewhat loose and are not relied upon to bring the reflector surfaces 90 into flush registration. Upon assembly of the reflector from the rear, the front faces 90 of the adjoining segments 11 and 12, for example, will meet each other flush at their marginal edges and the front face of the entire reflector 10 will be a uniform face. If a reflecting material 105 is incorporated with each segment, a concave reflector suitable for radio antenna use in the microwave frequency ranges will be provided. Preferably, the front surfaces 90 of the reflector segments are given a "pebbled" contour, during the molding process, so as to scatter incident light, or solar energy.

It will be seen from the foregoing description that each of the segments 11–18 inclusive is a substantially identical rigid body, and that the reflector 10 is assembled from a number of these segments, for example 8, into a rigid concave reflector. Assembly of the reflector is accomplished entirely from the rear surface, there being no need for any worker to work at the front surface 90 at any time during the assembly. The segments 11–18 inclusive include integral sectors of a mounting ring 20, which can be joined one to the other with a rigid connecting device, which can also be used to mount the antenna to a stand. The segments are self-indexing to provide a smooth flush front surface and with it an accurate concave reflector for microwave radio purposes. This is important because the reflectors of the invention are intended for use in sighting on distant sources, such as satellites, which requires that the antenna be bore-sighted to an accuracy of a small fraction of a degree of arc. While applicant has herein illustrated a presently-preferred embodiment of the invention, it is understood that the invention is not limited to details of this embodiment. Thus, for example, the reflector can be used as a solar energy collector, in which case the front surface 90 would incorporate a smooth light reflecting material. The claims which follow are intended to encompass all such uses to which reflectors of the invention my be put.

I claim:

1. A concave reflector for radiant energy in the frequency range including radio frequencies and visible light, said reflector being made of substantially identical segments which can be assembled along radial boundary lines to form a complete reflector, each segment being independently formed in a fixed substantially rigid configuraton of moldable material having a front portion providing a segment of reflector surface and a rear portion containing integrally-formed rigidizing ribs including at least a first radial rib along a first radial edge and a second radial rib along the second radial edge of said segment, means for fastening the first rib of one segment to the second rib of a next-adjoining segment in the assembly of a complete reflector, said first and second ribs including integrally-formed indexing means for so mating each pair of adjoining first and second ribs when the latter are fastened together during assembly of a complete reflector that said segments of reflector surface form a substantially continuous reflector in which meeting edges of adjoining segments are substantially flush with each other, in which said indexing means comprises a first set of tabs on the rear edge of each first rib which overlie and touch the rear edge of the second rib to which it is fastened, and a second set of tabs on said rear edge of said second rib which overlie and touch the rear edge of said first rib, said tabs of said first set being alternated with said tabs of said second set in a radial direction when said two adjoining ribs are fastened together thereby assuring a substantially flush front reflector surface.

2. A concave reflector according to claim 1 in which each segment is integrally-formed.

3. A concave reflector according to claim 1 in which each segment is an assembly of parts which meet in a circular locus having a radius which is less than the radius of a complete reflector.

4. A concave reflector according to claim 1 in which said moldable material is a dielectric and an electrically conductive material is incorporated in each segment adjacent said reflector surface.

5. A concave reflector according to claim 1 in which each of said segments is compression-molded.

6. A concave reflector according to claim 1 in which the front surface has an integrally-molded texture which scatters incident solar energy while concentrating radio frequency energy.

7. A concave reflector according to claim 1 having the shape of a paraboloid.

8. A concave reflector according to claim 1 which has a smooth front surface capable of concentrating solar energy.

9. A concave reflector for radiant energy in the frequency range including radio frequencies and visible light, said reflector being made of substantially identical segments which can be assembled along radial boundary lines to form a complete reflector, each segment being independently formed in a fixed substantially rigid configuraton of moldable material having a front portion providing a segment of reflector surface and a rear portion containing integrally-formed rigidizing ribs including at least a first radial rib along a first radial edge and a second radial rib along the second radial edge of said segment, means for fastening the first rib of one segment to the second rib of a next-adjoining segment in the assembly of a complete reflector, said first and second ribs including integrally-formed indexing means for so mating each pair of adjoining first and second ribs when the latter are fastened together during assembly of a complete reflector that said segments of reflector surface form a substantially continuous reflector in which meeting edges of adjoining segments are substantially flush with each other, in which said rear portion of each segment contains also an integrally-molded support structure extending between the first and second radial edges, and fixed on a circular locus the radius of which is equal to or less than the radius of the reflector, and means fixed to said support structure for attaching said reflector to a support.

10. A concave reflector according to claim 9 in which a rigid connecting member is fastened from an end of one support structure to the adjoining end of the next-adjacent support structure, there being at least as many of said connecting members as there are pairs of adjoining ends of said support structure, so as to form a substantially rigid support ring at the rear of said reflector, at least some of said connecting members including means for attaching said reflector to a support.

11. A concave reflector according to claim 10 in which said support structure is a pair of substantially parallel circularly-oriented ribs, and said rigid connecting members are each fastened between said ribs at the adjoining ends of said support structures.

12. A concave reflector according to claim 9 in which each of said segments is compression-molded.

13. A concave reflector for radiant energy in the frequency range including radio frequencies and visible light, said reflector being made of substantially identical segments which can be assembled along radial boundary lines to form a complete reflector, each segment being independently formed in a fixed substantially rigid configuraton of moldable material having a front portion providing a segment of reflector surface and a rear portion containing integrally-formed rigidizing ribs including at least a first radial rib along a first radial edge and a second radial rib along the second radial edge of said segment, means for fastening the first rib of one segment to the second rib of a next-adjoining segment in the assembly of a complete reflector, said first and second ribs including integrally-formed indexing means for so mating each pair of adjoining first and second ribs when the latter are fastened together during assembly of a complete reflector that said segments of reflector surface form a substantially continuous reflector in which meeting edges of adjoining segments are substantially flush with each other, having radially-oriented ribs and circumferentially oriented ribs which cross each other, including a joining boss at each crossing, said boss being a relatively thick part having a flat top against which ejection pins in a forming mold can push to eject a finished segment, said parts providing strength to said segment both during ejection and during operational use of the reflector.

* * * * *